US006779904B1

(12) United States Patent
Van Dyk

(10) Patent No.: US 6,779,904 B1
(45) Date of Patent: Aug. 24, 2004

(54) TITLE RACK LIGHTING FOR JUKEBOX

(75) Inventor: Richard Van Dyk, Kentwood, MI (US)

(73) Assignee: Rowe International Corporation, Grand Rapids, MI (US)

( * ) Notice: Subject to any disclaimer, the term of this patent is extended or adjusted under 35 U.S.C. 154(b) by 0 days.

(21) Appl. No.: 10/229,894

(22) Filed: Aug. 28, 2002

(51) Int. Cl.[7] ..... G09G 5/00

(52) U.S. Cl. ..... 362/86; 362/87; 362/802; 362/276; 345/700

(58) Field of Search ..... 362/86, 87, 802, 362/276, 253; 345/700, 772, 866, 327

(56) References Cited

U.S. PATENT DOCUMENTS 4,256,009 A 3/1981 Verduin et al. ..... 84/464 R
4,336,935 A * 6/1982 Goldfarb ..... 273/1 E
5,117,407 A 5/1992 Vogel ..... 369/30
5,771,778 A * 6/1998 MacLEan, IV ..... 99/323.6
6,048,271 A * 4/2000 Barcelou ..... 463/48
6,079,985 A * 6/2000 Wohl et al. ..... 434/319
6,086,380 A * 7/2000 Chu et al. ..... 434/307 A
6,346,951 B1 * 2/2002 Mastronardi ..... 345/716
6,466,232 B1 * 10/2002 Newell et al. ..... 345/700

* cited by examiner

*Primary Examiner*—Thomas M. Sember
*Assistant Examiner*—Anabel Ton
(74) *Attorney, Agent, or Firm*—Van Dyke, Gardner, Linn & Burkhart, LLP

(57) ABSTRACT

A music jukebox includes a music reproduction system, a title rack assembly, a cabinet for the title rack and a lighting system for the cabinet. The lighting system includes at least one lighting assembly producing light within a field of view of a user viewing the title rack. The jukebox further includes a control system that is operative to detect the presence of a user at the cabinet. The control operates the lighting system in an attract mode when the control does not detect the presence of a user at the cabinet and a viewing mode when the control system does detect the presence of a user at the cabinet.

39 Claims, 6 Drawing Sheets

TITLE RACK LIGHTING FOR JUKEBOX

BACKGROUND OF THE INVENTION

The present invention pertains to a musical jukebox system and, in particular, to a lighting system for such musical jukebox system.

Musical jukeboxes are entertainment devices and, as such, are designed to be attractive and eye-catching in appearance. Toward this end, it is common to provide lighting systems that present various visual effects, known as attraction, or attract, particularly in the jukebox cabinet.

Musical jukeboxes traditionally have a title rack in order to present to the user a display of the titles that are available for selection in combination with a selection device, such as a keypad, that allows the user to make a selection. The title rack is commonly a multiple-page arrangement with the pages mounted to flip about either a vertical or a horizontal axis in order to allow the user to flip through the various titles that are available.

SUMMARY OF THE INVENTION

The present invention is directed to a musical jukebox and method of illumination of a jukebox having a music reproduction system, a cabinet and a lighting system for the cabinet. The jukebox further includes a control for operating the lighting system. The control operates the lighting system in an attract mode when a user is not at the cabinet and in an illumination mode when a user is at the cabinet.

A musical jukebox and method of illumination of a jukebox having a music reproduction system, a title rack assembly, and a lighting system for the cabinet, according to an aspect of the invention, includes providing at least one light assembly producing light within a field of view of a user viewing said title rack and a control system. The control system is operative to detect the presence of a user at the cabinet. The control operates the lighting system in an attract mode when a user is not at the cabinet and an illumination mode when a user is at the cabinet.

A musical jukebox and method of illumination of a jukebox having a music reproduction system, a title rack assembly, and a lighting system for the cabinet, according to another aspect of the invention, includes providing at least one light assembly producing light within a field of view of a user viewing said title rack and a control system. The control includes a proximity sensor to detect a user with a field of detection of the sensor and operates the at least one light assembly in an attract mode when the proximity sensor does not detect a user and an illumination mode when the proximity sensor detects a user.

These and other objects, advantages, and features of this invention will become apparent upon review of the following specification in conjunction with the drawings.

BRIEF DESCRIPTION OF THE DRAWINGS

FIG. 3 is an electrical schematic diagram of a computer-based control;

DETAILED DESCRIPTION OF THE PREFERRED EMBODIMENT

Figure 1:
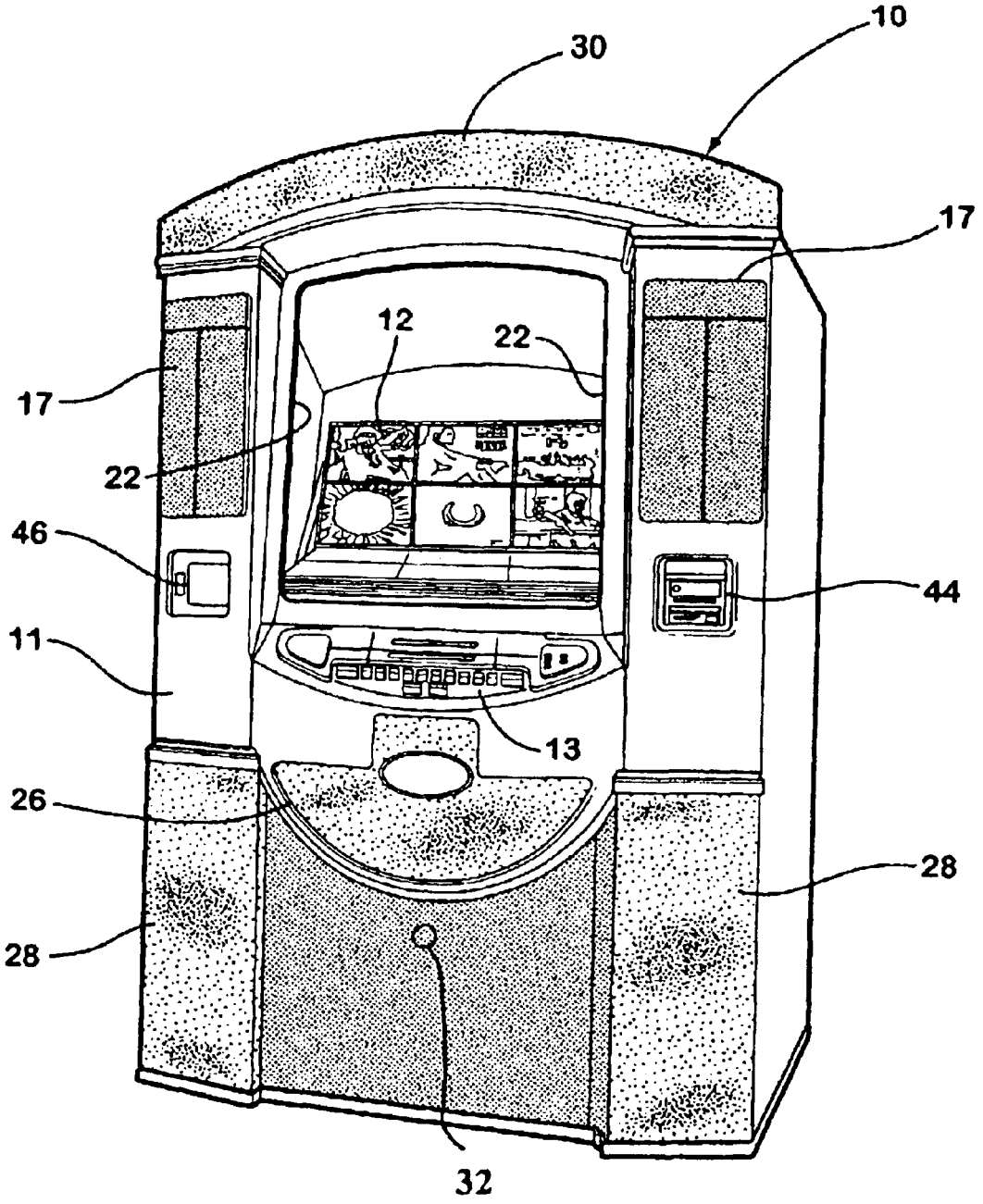
FIG. 1 is a perspective view of a musical jukebox, according to the invention.

Referring to the drawings and the illustrative embodiments depicted therein, a musical jukebox 10 includes a cabinet 11 and a musical production system including speakers 17 for reproducing music selected by a user (FIG. 1). Jukebox 10 includes a bill or credit/debit card acceptor 44 and/or a coin acceptor 46 in order to receive a user's payment for the selections and a selector, such as a keyboard 13, to receive a user's selection. Jukebox 10 further includes a title rack 12 for displaying information on the musical titles that are available for selection. As is common, the title rack contains a plurality of pages that each has multiple locations for displaying information, such as an insert that typically accompanies a music compact disk. Title rack 12 may be a vertically hinged title rack, such as disclosed in commonly assigned U.S. Pat. No. 5,031,346, or a horizontally hinged title rack, such as disclosed in commonly assigned U.S. Pat. No. 5,704,146, both of which are hereby incorporated herein by reference. Jukebox 10 may have a freestanding cabinet 11 or a wall box system in which cabinet 11 is wall mounted. In both such applications, most or all of the sound production system is located within cabinet 11. However, the invention could be embodied in a system wherein at least some of the sound production system is separate from cabinet 11. The music reproduction system of jukebox 10 includes a music reader, such as a compact disk reader, a disk transfer device and disk storage device, all of which are known in the art. The disk storage device may be moveable to bring the selected disk into juxtaposition with the disk transfer device as disclosed in commonly assigned U.S. Pat. No. 5,050,148, the disclosure of which is hereby incorporated herein by reference. Alternatively, the disk storage device may be stationary and the disk transfer device moves to the location of the selected disk as disclosed in commonly assigned U.S. Pat. No. 6,373,796, the disclosure of which is hereby incorporated herein by reference.

Figure 2A:
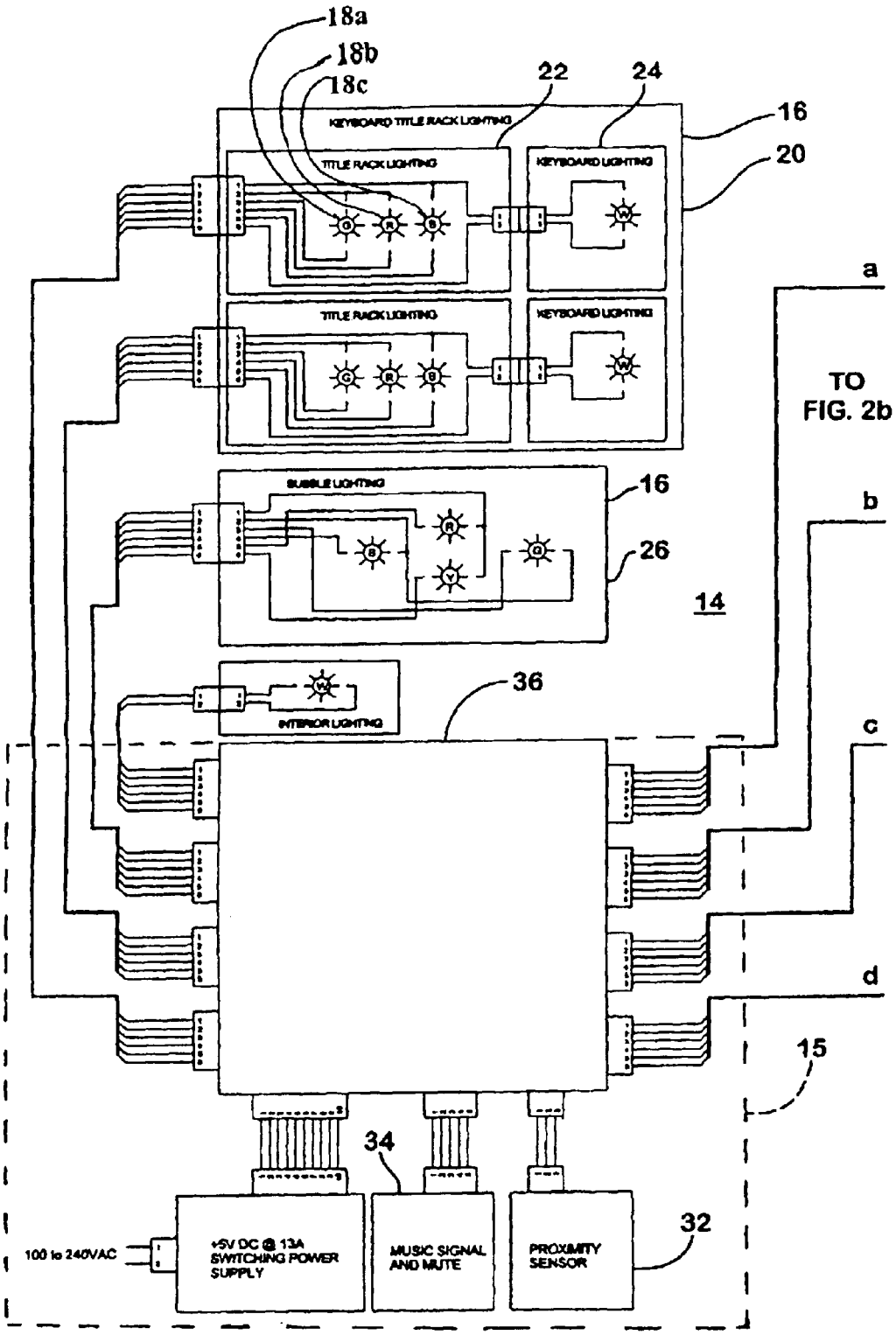
FIGS. 2*a* and 2*b* are an electrical block diagram of a lighting system, according to the invention.
Figure 2B:
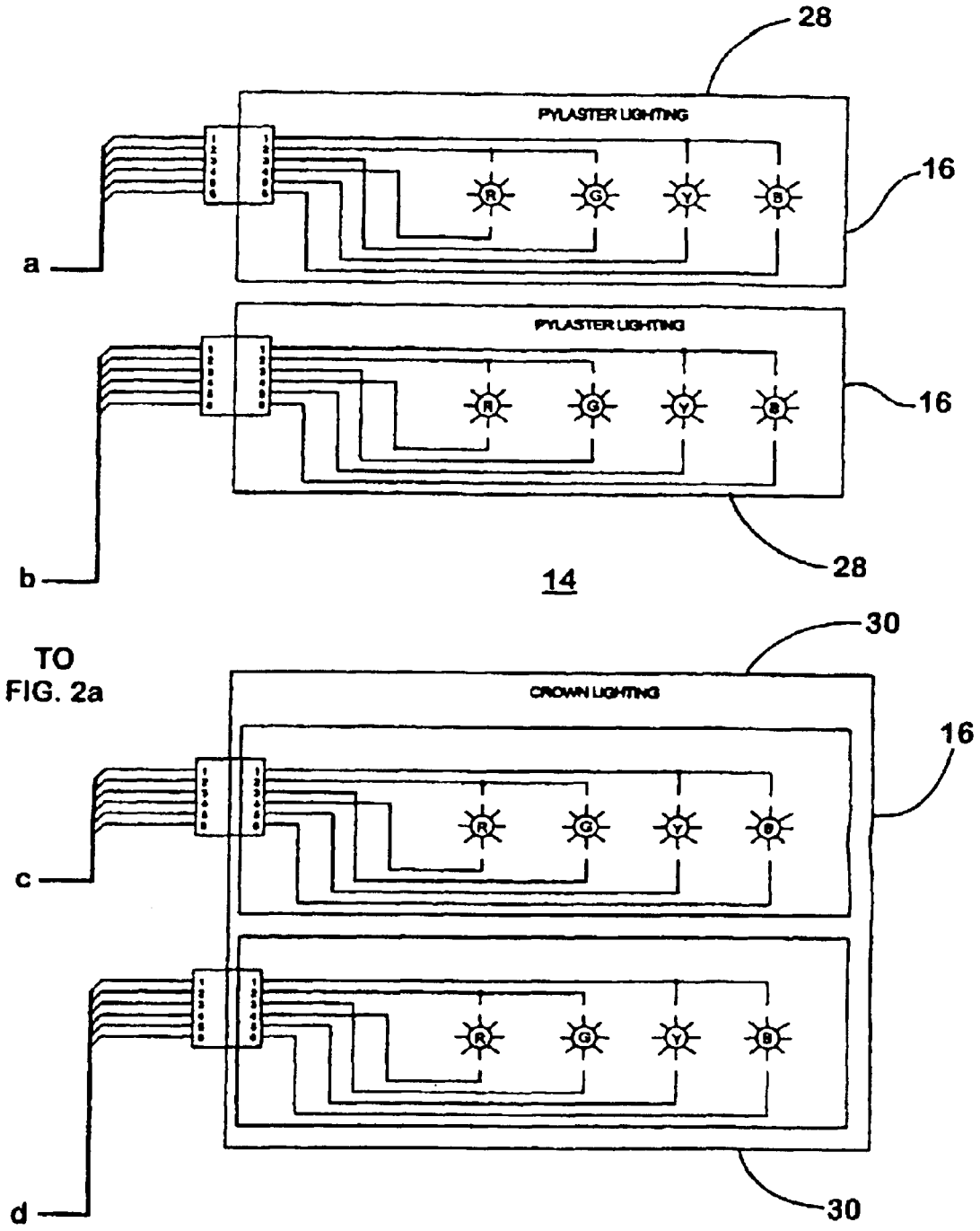

Jukebox 10 includes a lighting system 14 made up of a control 15 and a plurality of lighting boards, or assemblies, 16 (FIGS. 1, 2*a* and 2*b*). The lighting boards in the illustrative embodiment include a title rack lighting board 22, a keyboard light board 24, a bubble light assembly 26, a pilaster lighting assembly 28 and a crown lighting assembly 30. The number and types of boards is illustrative only and may vary depending upon the aesthetic design of the cabinet. Each light assembly 16 is made up of a plurality of lamps, which, in the illustrative embodiment, are light-emitting diodes (LEDs) 18. LEDs 18 may be made up of different colors that may be illuminated in various combinations to make up various colors or, when all illuminated, make white light. LEDs 18 are illustrated as including green illuminating LEDs 18*a*, red illuminating LEDs 18*b* and blue illuminating LEDs 18*c*. In the illustrative embodiment, either one individual colored LED or two different colored LEDs may be illuminated together in order to produce another color or all three may be illuminated together to produce white light.

Figure 4:
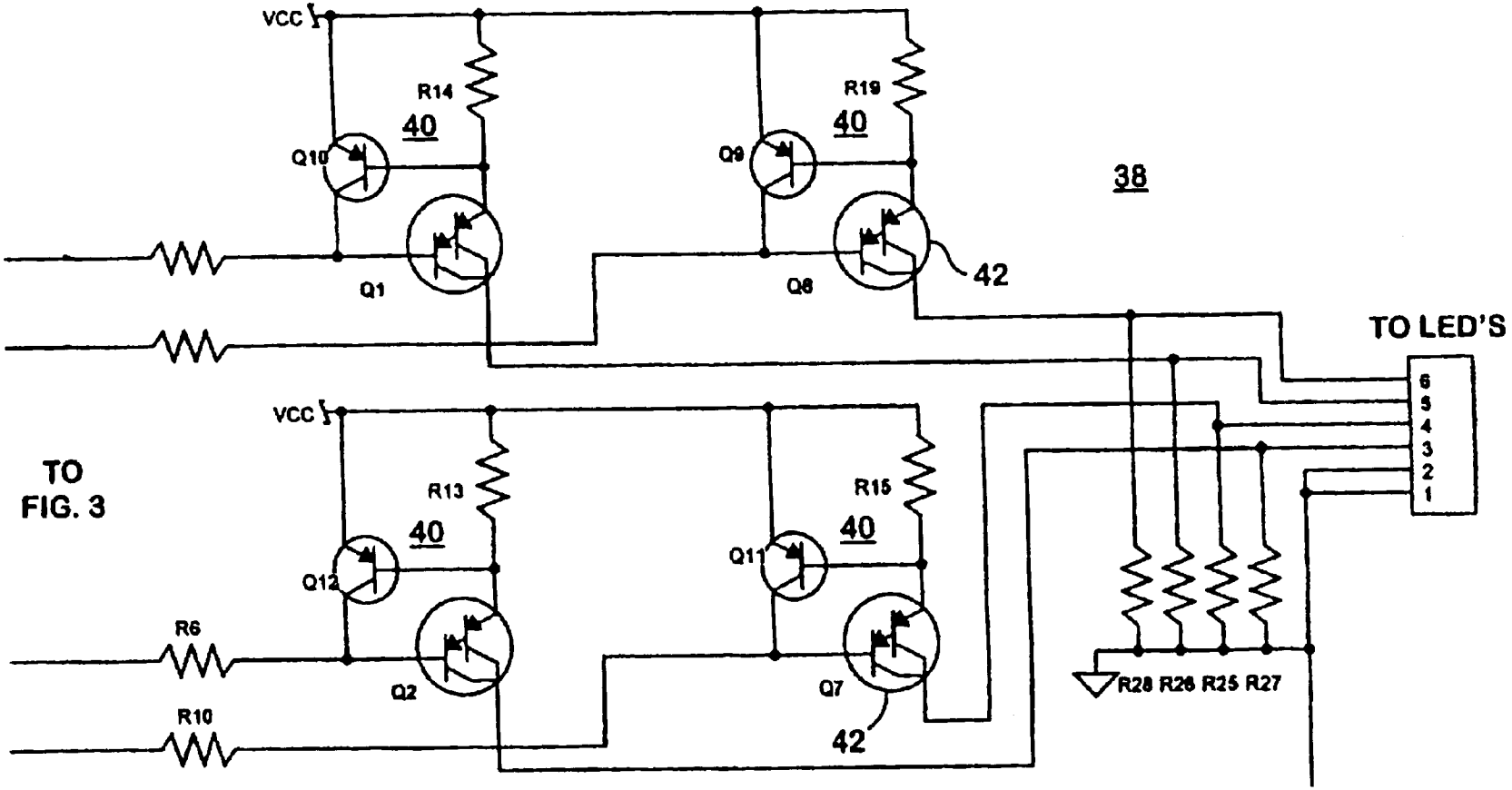
FIG. 4 is an electrical schematic diagram of a light-emitting diode (LED) switching assembly.

Lighting system 14 includes a control 15 having a computer-based controller 36, which receives inputs from a proximity sensor 32, and a music signal and mute circuit 34 (FIGS. 2*a*, 2*b* and 3). Computer-based controller 36 includes a microprocessor U3 and a plurality of latch circuits U6, U7, U8, and U12, which supply pulse-width modulated signals to a plurality of LED switching assemblies 38 (FIGS. 3 and 4). Switching assemblies 38 each include a Darlington pair solid-state switch 40, which supplies high-side switching to each LED, the other terminal of which is connected with ground or chassis potential. The LEDs may be controlled as to intensity such as by varying the modulation of the pulse-width, or by other known techniques. If one colored LED is illuminated, a particular color is produced.

Figure 5:
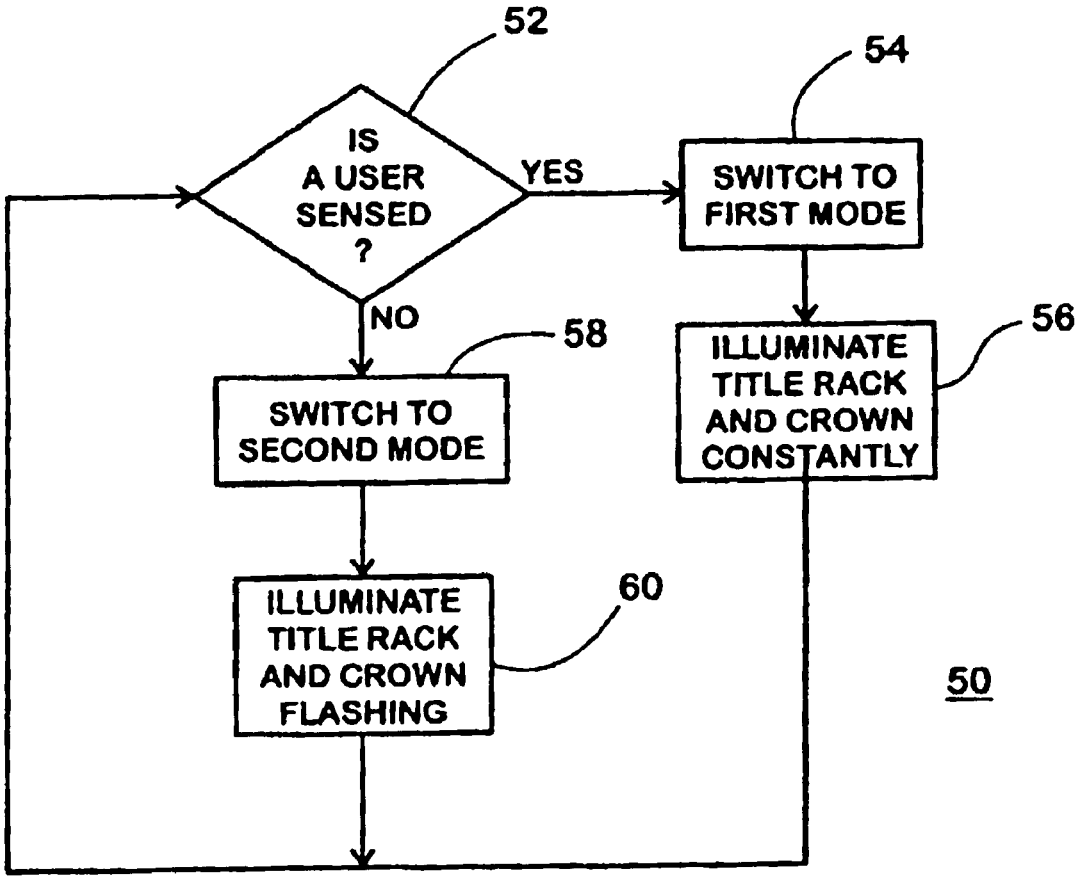
FIG. 5 is a flowchart of a control algorithm.
Figure 5:
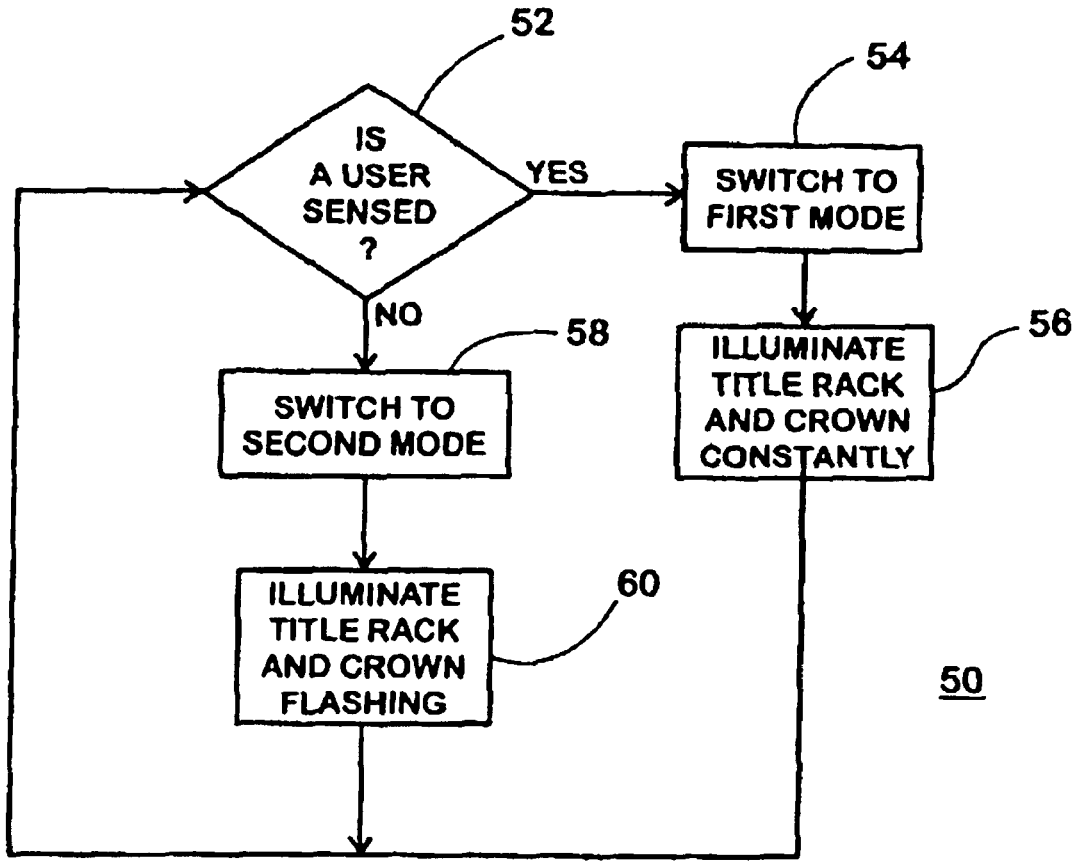

Control 15 operates according to a control algorithm 50 (FIG. 5). Controller 36 monitors proximity sensor 32 and thereby determines at 52 whether or not a user is within a field of detection of the sensor and thereby detects the presence of a user at cabinet 11. If controller 36 determines at 52 that a user is not at cabinet 11, then the LEDs 18 of the various lighting boards, including title rack lighting board 22 and the crown lighting assembly, are operated in an aesthetic, or attract, mode 58 in which the LEDs are operated at 60 in a flashing fashion of color light in a pattern or random fashion that is established by the system designer. This produces an aesthetically pleasing show that may, optionally, be different, for example, depending on whether the music reproduction system is playing a song or not.

If controller 36 determines at 52 that a user is at cabinet 11, the lighting system is operated in a viewing mode 54 that is conducive to a user reading the title rack and making selections of a song. In mode 54, the LEDs 18 that are generally within the vision field of a user, including peripheral vision, are no longer operated in a switched or flashing mode. This avoids distracting the user by the flashing of the LEDs. In the illustrative embodiment, the LEDs of title rack lighting board 22 and crown lighting assembly 30 are operated in a non-flashing fashion in viewing mode 54. In particular, the LEDs of title rack lighting board 22 are illuminated substantially constantly at a single color that enhances visibility of title rack 12. In the illustrative embodiment, all of the LEDs of title rack 12 are constantly illuminated in mode 54 to wash the title rack with white light, which provides maximum contrast to the graphics displayed on the title rack. In the illustrative embodiment, the LEDs of crown lighting assembly are illuminated substantially constantly at various colors, but at a reduced lighting level compared with the attract mode. This maintains some aesthetic appearance without significantly distracting a user making a music selection. Because pilaster lighting assemblies 28 and the bubble lighting assembly 26 are substantially outside of the peripheral vision of a user attempting to make a selection, they may be illuminated in a flashing attraction mode even when a user is detected by proximity sensor 32.

Proximity sensor 32 can be any type known in the art. By way of example, proximity sensor 32 may be a capacitive sensor, a radar sensor, an infrared sensor, an optical sensor, or the like.

Controller 36 may vary the illumination of the various LEDs in response to a music signal produced by music signal and mute circuit 34 so that the lighting effect in the attract mode changes according to the rhythm of the music being produced by jukebox 10.

The present invention allows a jukebox lighting system that is more eye-catching and, therefore, more noticeable than previously possible. This is because the user is not distracted by the attract mode of the lighting system while the user is attempting to make a selection. A user is provided a relatively serene visual presentation with good reading contrast, which encourages the user to spend time making additional selections. In this manner, the present invention has the potential to enhance the economic production of the jukebox by, on one hand, attracting the attention of potential users to the presence of the jukebox while, on the other hand, providing a serene setting for a user in the proximity of the jukebox.

Although the invention is illustrated as changing the illumination mode of titled rack lighting as a function of the detected presence or absence of a user, other applications are possible. For example, the illumination may change between one aesthetic mode and a different aesthetic mode, such as a lower intensity aesthetic mode, when a user approaches the jukebox. Although the invention was illustrated for use with a conventional title rack type jukebox playing compact disk selections, it may also have applications with other types of jukeboxes. For example, the invention may have application to jukeboxes utilizing a touch screen for displaying titles and receiving a user selection. It may also find application with jukeboxes that download music from a remote source. The invention may also find application with jukeboxes that display videos along with the music and with other entertainment systems, such as video game devices, and the like.

Changes and modifications in the specifically described embodiments can be carried out without departing from the principles of the invention, which is intended to be limited only by the scope of the appended claims, as interpreted according to the principles of patent law including the Doctrine of Equivalents.

The embodiments of the invention in which an exclusive property or privilege is claimed are defined as follows:

1. A musical jukebox, comprising:

a music reproduction system;

a title rack assembly including a plurality of display areas for displaying song titles that are available for play;

a cabinet for said title rack; and a lighting system for said cabinet, said lighting system including at least one light assembly producing light within a field of view of a user viewing said title rack and a control system, said control system operative to detect the presence of a user at said cabinet;

said control system operating said lighting system in an attract mode when said control system does not detect the presence of a user at said cabinet and a viewing mode when said control system does detect the presence of a user at said cabinet.

2. The jukebox of claim 1 wherein said control system operates said at least one light assembly at substantially constant illumination in said viewing mode.

3. The jukebox of claim 2 wherein said control system operates said at least one light assembly in an illumination mode that enhances visibility of said title rack in said viewing mode.

4. The jukebox of claim 3 wherein said illumination mode comprises a substantially constant illumination at a substantially white color.

5. The jukebox of claim 4 wherein said at least one light assembly is made up of a plurality of LEDs operative at different colors and wherein said substantially white color is produced from multiples of said LEDs substantially constantly actuated.

6. The jukebox of claim 5 wherein said plurality of LEDs comprise at least one red color LED, at least one blue color LED and at least one green color LED and wherein said substantially white color is produced from said at least one red color LED, said at least one blue color LED and said at least one green color LED are substantially constantly actuated.

7. The jukebox of claim 1 wherein said attract mode comprises a flashing illumination.

8. The jukebox of claim 7 wherein said attract mode comprises a flashing illumination at multiple different colors.

9. The jukebox of claim 8 wherein said at least one light assembly is made up of a plurality of LEDs operative at different colors and wherein said multiple different colors are produced from different of said LEDs being intermittently actuated.

10. The jukebox of claim 9 wherein said plurality of LEDs comprise at least one red color LED, at least one blue color LED and at least one green color LED and wherein said multiple different colors are produced from said at least one red color LED, said at least one blue color LED and said at least one green color LED being intermittently actuated at least one chosen from individually and in pairs.

11. The jukebox of claim 10 including modulation of intensity of actuated ones of said LEDs.

12. The jukebox of claim 11 wherein said modulation comprises pulse-width modulation.

13. The jukebox of claim 7 wherein said music reproduction system produces a music signal and wherein said flashing is in response to said music signal.

14. The jukebox of claim 1 including a proximity sensor for detecting the presence of a user at said cabinet.

15. The jukebox of claim 14 wherein said proximity sensor comprises at least one chosen from a capacitive sensor, a radar sensor, an infrared sensor and an optical sensor.

16. The jukebox of claim 1 wherein said lighting system includes at least a crown lighting assembly above said title rack and a title rack lighting assembly lateral of said title rack.

17. The jukebox of claim 16 wherein said at least one light assembly comprises said crown lighting assembly and said title rack lighting assembly.

18. The jukebox of claim 1 wherein said lighting system includes at least one other light assembly producing light not substantially within a field of view of a user viewing said title rack and wherein said control operates said at least one other light assembly in said attract mode irrespective of a user's presence at said cabinet.

19. A musical jukebox, comprising:

a music reproduction system;

a title rack assembly including a plurality of display areas for displaying song titles that are available for play;

a cabinet for said title rack; and a lighting system for said cabinet, said lighting system including at least one light assembly producing light within a field of view of a user viewing said title rack and a control system, wherein said at least one light assembly is made up of a plurality of LEDs operative at different colors, said control system including a proximity sensor to detect a user within a field of detection of said sensor;

said control system operating said at least one light assembly in an attract mode when said proximity sensor does not detect a user and a viewing mode when said proximity sensor senses a user.

20. The jukebox of claim 19 wherein said control system operates said at least one light assembly at a substantially constant illumination in said viewing mode.

21. The jukebox of claim 20 wherein said at least one light assembly enhances visibility of said title rack in said viewing mode.

22. The jukebox of claim 21 wherein said viewing mode comprises a substantially constant illumination at a substantially white color.

23. The jukebox of claim 22 wherein said substantially white color is produced from multiples of said LEDs substantially constantly actuated.

24. The jukebox of claim 23 wherein said plurality of LEDs comprise at least one red color LED, at least one blue color LED and at least one green color LED and wherein said substantially white color is produced from said at least one red color LED, said at least one blue color LED and said at least one green color LED are substantially constantly actuated.

25. The jukebox of claim 19 wherein said at least one light assembly enhances appearance of said cabinet in said attract mode.

26. The jukebox of claim 25 wherein said attract mode comprises a flashing illumination.

27. The jukebox of claim 25 wherein said attract mode comprises a flashing illumination at multiple different colors.

28. The jukebox of claim 27 wherein said multiple different colors are produced from different of said LEDs being intermittently actuated.

29. The jukebox of claim 28 wherein said plurality of LEDs comprise at least one red color LED, at least one blue color LED and at least one green color LED and wherein said multiple different colors are produced from said at least one red color LED, said at least one blue color LED and said at least one green color LED being intermittently actuated at least one chosen from individually and in pairs.

30. The jukebox of claim 29 including modulation of intensity of actuated ones of said LEDs.

31. The jukebox of claim 30 wherein said modulation comprises pulse-width modulation.

32. The jukebox of claim 26 wherein said music reproduction system produces a music signal and wherein said flashing is in response to said music signal.

33. The jukebox of claim 19 wherein said proximity sensor comprises at least one chosen from a capacitive sensor, a radar sensor, an infrared sensor and an optical sensor.

34. The jukebox of claim 19 wherein said lighting system further includes as a crown lighting assembly above said title rack and a title rack lighting assembly lateral of said title rack.

35. The jukebox of claim 34 wherein said at least one light assembly comprises said crown lighting assembly and said title rack lighting assembly.

36. The jukebox of claim 19 wherein said lighting system includes at least one other light assembly producing light not substantially within a field of view of a user viewing said title rack and wherein said control operates said at least one other light assembly in said attract mode irrespective of a user's presence at said cabinet.

37. A method of illuminating a musical jukebox having a music reproduction system, a title rack assembly including a plurality of display areas for displaying song titles that are available for play, a cabinet for said title rack, and a lighting system for said cabinet, said lighting system including at least one light assembly s producing light within a field of view of a user viewing said title rack, said method comprising:

detecting the presence of a user at said cabinet;

operating said lighting system in an attract mode when a user is not present at said cabinet and in an illumination mode when a user is present at said cabinet.

38. The method of claim 36 wherein said operating said lighting system in said viewing mode comprises enhancing visibility of said title rack.

39. The method of claim 1 wherein said operating said lighting system in said attract mode comprises enhancing ornamental appearance of said cabinet.

* * * * *